United States Patent [19]

Lundmark

[11] Patent Number: 5,012,627

[45] Date of Patent: May 7, 1991

[54] CONSTRUCTION PROCESS FOR MULTIPLE-STORY CONCRETE BUILDING

[76] Inventor: Bo J. Lundmark, 3219 Overland Ave., #9197 Los Angeles, Ca. 90034

[21] Appl. No.: 357,331

[22] Filed: May 25, 1989

[51] Int. Cl.[5] ..... E04B 1/16

[52] U.S. Cl. ..... 52/741; 264/33; 264/34

[58] Field of Search ..... 264/33, 34; 249/20, 249/27, 22; 52/745, 741, 125.1, 122.1

[56] References Cited

U.S. PATENT DOCUMENTS

| | | | |
|---|---|---|---|
| 1,701,113 | 2/1929 | Keller . | |
| 3,275,719 | 9/1966 | Dudson | 264/33 |
| 3,510,098 | 5/1970 | Fox | 249/20 |
| 3,761,551 | 9/1973 | Ogata | 264/33 |
| 4,029,286 | 6/1977 | Ahl | 264/33 |
| 4,691,485 | 9/1987 | Nagy | 52/745 |

FOREIGN PATENT DOCUMENTS

| | | |
|---|---|---|
| 76959 | 6/1950 | Norway . |
| 566120 | 12/1944 | United Kingdom . |

*Primary Examiner*—John E. Murtagh

*Attorney, Agent, or Firm*—Bo J. Lundmark

[57] ABSTRACT

An improved process for constructing a multiple-story, reinforced concrete building, in which a central core tower is first erected on a conventional foundation by moving concrete forms incrementally upwardly. A work platform is mounted for self-propelled movement along the top side of the core forms, to move men and equipment to selected locations on the core tower as it is being erected, thus simplifying the construction and substantially reducing costs. Afer the core tower has been erected, floor slabs and integral, underlying walls are constructed from the uppermost floor downwardly using slab/wall forms that can be moved repeatedly downwardly without requiring disassembly and reassembly for each story. The integral, underlying walls associated with each floor slab provide the support structure for each story, thus permitting the slab/wall forms to be lowered without the need for re-shoring.

18 Claims, 5 Drawing Sheets

CONSTRUCTION PROCESS FOR MULTIPLE-STORY CONCRETE BUILDING

BACKGROUND OF THE INVENTION

This invention relates generally to processes for constructing reinforced concrete buildings and, more particularly, to processes for constructing such buildings of multiple stories and in situ.

Constructing multiple-story buildings of reinforced concrete is a particularly cost effective form of construction in many applications. Many high rise hotels, with symmetrical shapes and a large number of identically-shaped rooms, are so constructed.

Conventional construction processes of this kind initially erect wall-, column- and slab- forms for the first story on top of a suitable foundation, after which fluid concrete is placed in the forms and allowed to cure, or harden. The forms are then disassembled from beneath the floor slab just produced and, after appropriate cleaning, reassembled on top of the same slab for subsequent use in producing a succeeding story. Since the concrete from the first story typically at this time has not yet reached its design strength, the slab is re-shored to withstand the forces imposed on it by its own weight and by the weight of the forms for the continued upward construction. Such re-shoring is typically accomplished by placing adjustable wood or metal shores beneath the recently-poured slab.

The cycle of erecting forms, placing fluid concrete in the forms, curing the concrete, and removing and reassembling the forms on top of the just-completed slab is repeated until the desired building height has been reached. Thereafter, appropriate roofing is applied and appropriate interior finishing can take place.

Although the conventional concrete construction process described briefly above has proven to be generally satisfactory in most situations, it is believed to be unduly expensive. In particular, excessive delays and labor costs are believed to be incurred in disassembling, cleaning and reassembling the concrete forms.

It should, therefore, be appreciated that there is a need for an improved process for constructing reinforced concrete buildings that avoids the need to repeatedly disassemble, clean and reassemble the forms used to produce the building's successive stories and thus substantially reduces construction costs. The present invention fulfills this need.

SUMMARY OF THE INVENTION

The present invention resides in an improved process for constructing a multiple-story concrete building, which avoids the need for a relatively costly disassembly, cleaning and reassembly of concrete forms used in producing each successive story. In accordance with the invention, a multiple-story core tower is first erected, after which forms are constructed for a floor slab and one or more integral concrete walls positioned beneath the floor slab, all of which project horizontally outwardly from a location at or near the top of the tower. A horizontal support structure also is constructed for the slab and underlying wall forms, and fluid concrete is then placed in the forms, to produce the floor slab and integral underlying walls. The weight of the floor slab and integral walls is transferred directly to the core tower via the slab's and underlying wall's T-shaped cross-section. After the concrete has sufficiently cured, the forms and horizontal support structure are lowered intact, by a predetermined distance on the core tower, and fluid concrete is then placed in the forms to produce the next succeeding, i.e., lower, story. This process is repeated until the desired number of stories have been produced, i.e., when the foundation is finally reached. The building is thereby constructed without the need for any disassembly and reassembly of the concrete forms, thus providing a substantial savings in construction time and cost.

In a separate and independent feature of the invention, the core tower is erected as a series of stories, using forms that define two substantially parallel walls, with a work platform being movable along tracks carried on the tops of these parallel wall forms. The walls of the core tower are formed in successive stages, with the forms being raised (e.g., hydraulically) after each stage or story has been completed. In each case, the work platform is selectively movable along the tracks, to move men and equipment to selected portions of the forms and walls being produced. Interior walls of the core tower can be produced using forms that are suspended from the forms for exterior, parallel walls of the tower, such that lifting the forms for the exterior core tower walls simultaneously lifts the forms for the interior walls.

In a more detailed feature of the invention, the successive concrete walls produced in the repeated steps of placing and lowering are vertically aligned with each other, and the method includes a further step of initially suspending a plurality of reinforcing rods or strands from the site of the uppermost floor slab to the site of the lowermost floor slab. The forms for the underlying support walls enclose the strands, so that the support walls being produced are properly reinforced. The bottom edge of each successive wall is irregular, With a plurality of downward projections or teeth that are used in the subsequent step of lowering the forms as a guide for locating and spacing apart the forms for the next succeeding underlying wall.

In another feature of the invention, exterior walls are produced at the edges of the successive floor slabs furthest from the core tower in a fashion much like the main floor slabs and underlying walls, as described above. In particular, forms are initially constructed adjacent the uppermost floor slab, to receive concrete and thereby form the exterior wall, after which the forms are lowered into registration with the next lower floor slab and the process is repeated. In addition, the exterior wall forms also define a narrow floor slab segment integral with the exterior wall and abutting the corresponding, previously produced main floor slab. Fluid concrete placed in this form therefore produces both the exterior wall and an integral floor segment.

In another, more detailed feature of the invention, the core tower and the forms for the floor slabs carry cooperating indicia for use in the repeated steps of lowering the forms, to determine the predetermined distances the forms and horizontal support structure are to be lowered. This obviates the need to separately measure the distance the forms are being lowered at the time the lowering is performed.

In yet another feature of the invention, a plurality of concrete, integrated stair/rail segments are monolithically cast. Each such segment includes integral treads, risers, landing and railing, and it is cast on the ground and hoisted into place on the building.

Other features and advantages of the present invention should become apparent from the following description of the preferred process, taken in conjunction with the accompanying drawings, which illustrate by way of example, the principles of the invention.

DESCRIPTION OF THE PREFERRED PROCESS

Figure 1:
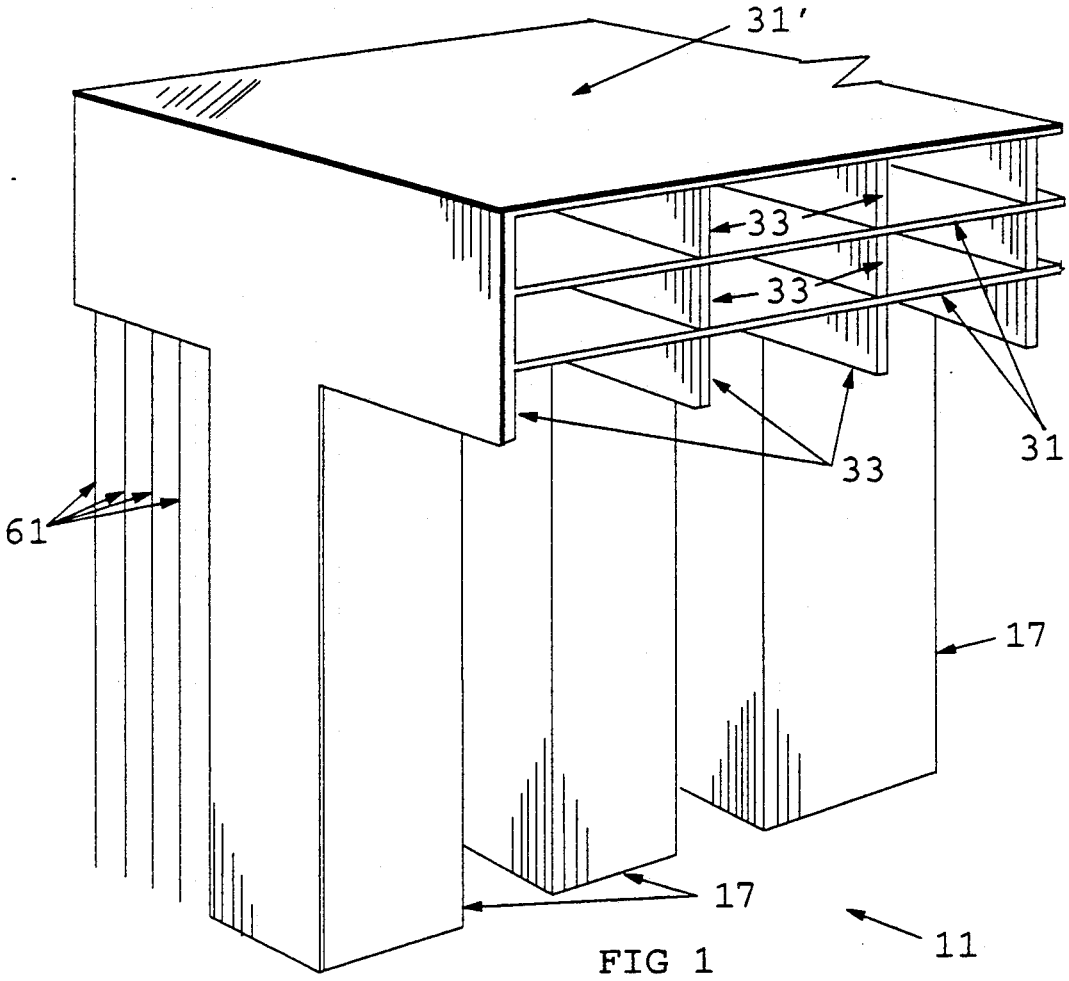
FIG. 1 is a perspective view of a partially completed, multiple-story, reinforced concrete building being constructed in accordance with the preferred process of the invention, the building being depicted without the concrete forms in place and without most of the reinforcement strands hung from the uppermost floor.
Figure 2:
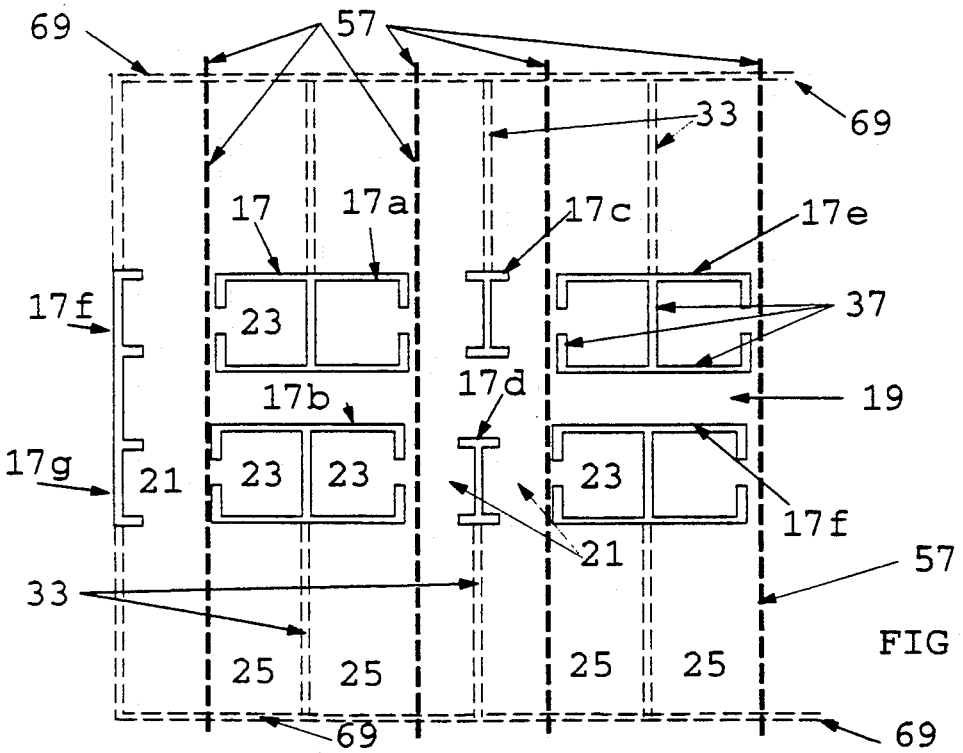
FIG. 2 is a plan view of a portion of the floor plan for the concrete building of FIG. 1.
Figure 3:
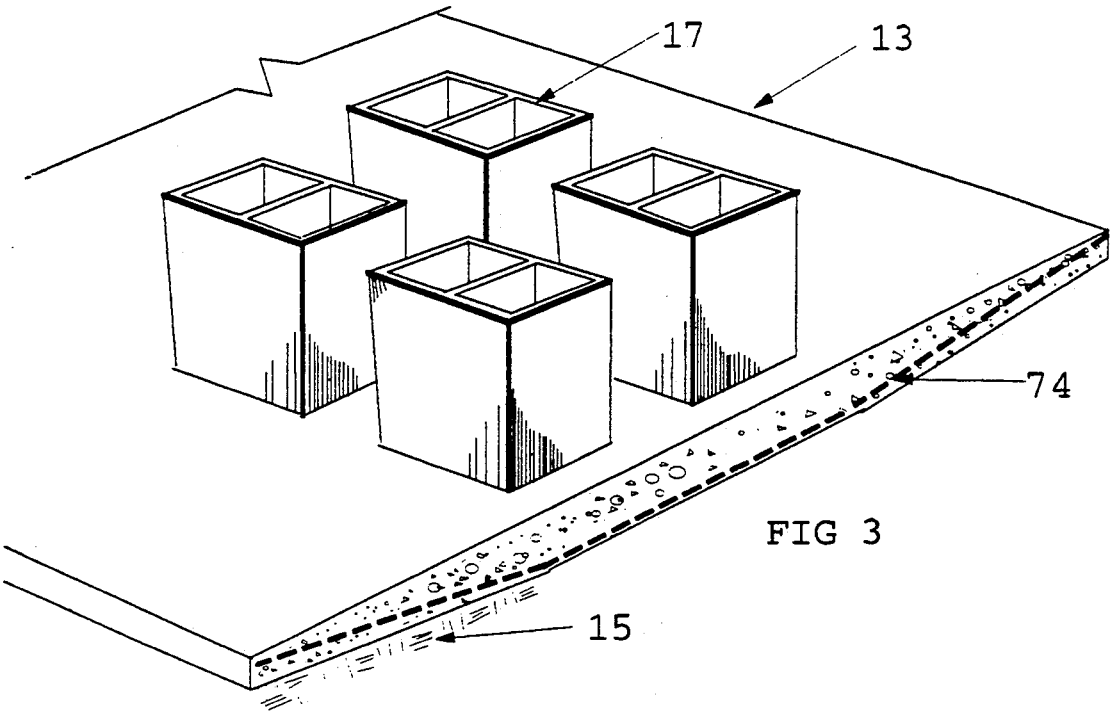
FIG. 3 is a perspective view of a portion of the foundation of the concrete building of FIG. 1.

With reference now to the drawings, and particularly to FIGS. 1–4, there is shown a multiple-story concrete building 11 in varying stages of its construction. The building includes a conventional reinforced concrete foundation 13 resting on the ground 15, with a centrally-located, multiple-story core tower 17 rising from a middle portion of the foundation. In the construction process, after the foundation and core tower have been constructed, the main portion of each story of the building is cantilevered outwardly in opposite directions from the tower, with the weight of each such story being transferred to the core tower directly, rather than through one or more underlying stories.

The building 11 advantageously can be used as a hotel. As shown most clearly in the floor plan view in FIG. 2, the core tower 17 actually takes the form of multiple, spaced-apart towers 17*a*, 17*b*, etc. arranged to have a generally rectangular outer perimeter. When the building is ultimately used, core tower space can advantageously be used as a central hallway 19 and as the entryways 21 and bathrooms 23 for the individual hotel rooms. The cantilevered floor areas surrounding the core tower are subdivided into individual bedrooms 25.

In accordance with the invention, the central core tower 17 is constructed initially, after which the cantilevered stories (FIG. 1) are constructed in sequence, from the uppermost story downwardly. This obviates the need to repeatedly disassemble and reassemble concrete forms 27 and 29 used to form the respective floor slab 31 and underlying walls 33 for each story, thereby providing a substantial savings in time and labor costs.

Figure 4:
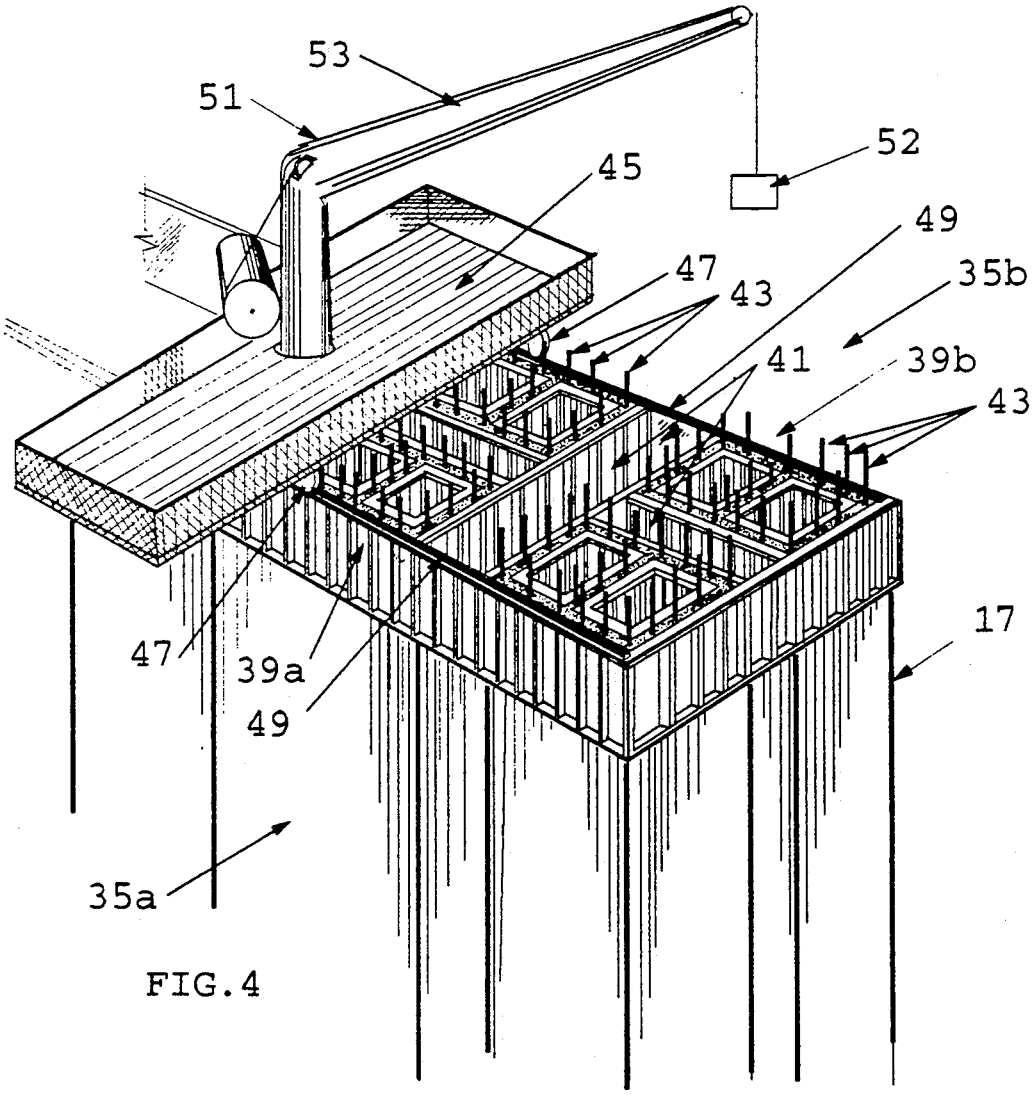
FIG. 4 is a perspective view of the core tower of the concrete building of FIG. 1 as it is being constructed, with forms defining the uppermost story of the core tower being depicted and with a movable work platform being depicted in one position on the forms.

More particularly, and with reference to FIG. 4, the central core tower 17 is constructed from the foundation slab 13 upwardly, one story at a time. The tower has a generally rectangular outer configuration, with parallel sidewalls 35*a* and 35*b* running along its length, typically in excess of 100 feet, and with an array of interior walls 37, as well. Wall forms 39*a* and 39*b* and 41 of conventional materials are provided for such walls, and reinforcement rods 43 are positioned both horizontally and vertically within the forms, to provide the required strength. After concrete is pumped into the forms and cured, the forms are lifted, typically about eight feet, into a position to produce the next succeeding story. A suitable wallcovering material (not shown) can be placed on the inwardly-facing surfaces of the forms by unfurling it from a roll as the forms are lifted. Exposed prestressing strands or Dyvitag rods (not shown) may be placed in the corners of the core tower and anchored to the foundation 13, to resist overturning moments during the construction.

The core tower forms 39*a* and 39*b* and 41 are opened, closed and lifted by any suitable means, such as an hydraulic ram, screw or other actuator resting in pockets (not shown) on the concrete walls 35*a* and 35*b* of the core tower level just produced. Lifting of the forms can be accomplished using relatively little power, by operating at a very low speed. Ideally, this lifting occurs at night, under computer control, while few workers, if any, are at the site.

In accordance with one feature of the invention, a movable, wheel-mounted work platform 45 is mounted on top of the forms 39*a* and 39*b* for the core tower 17, for selective movement along the length of the tower. This enables men and equipment to be moved to selected locations on the tower, during the construction of each succeeding story. Such equipment includes, for example, electrical power, lighting, compressed air, cleaning and oiling compounds, tools, first aid, and communication devices.

Figure 5:
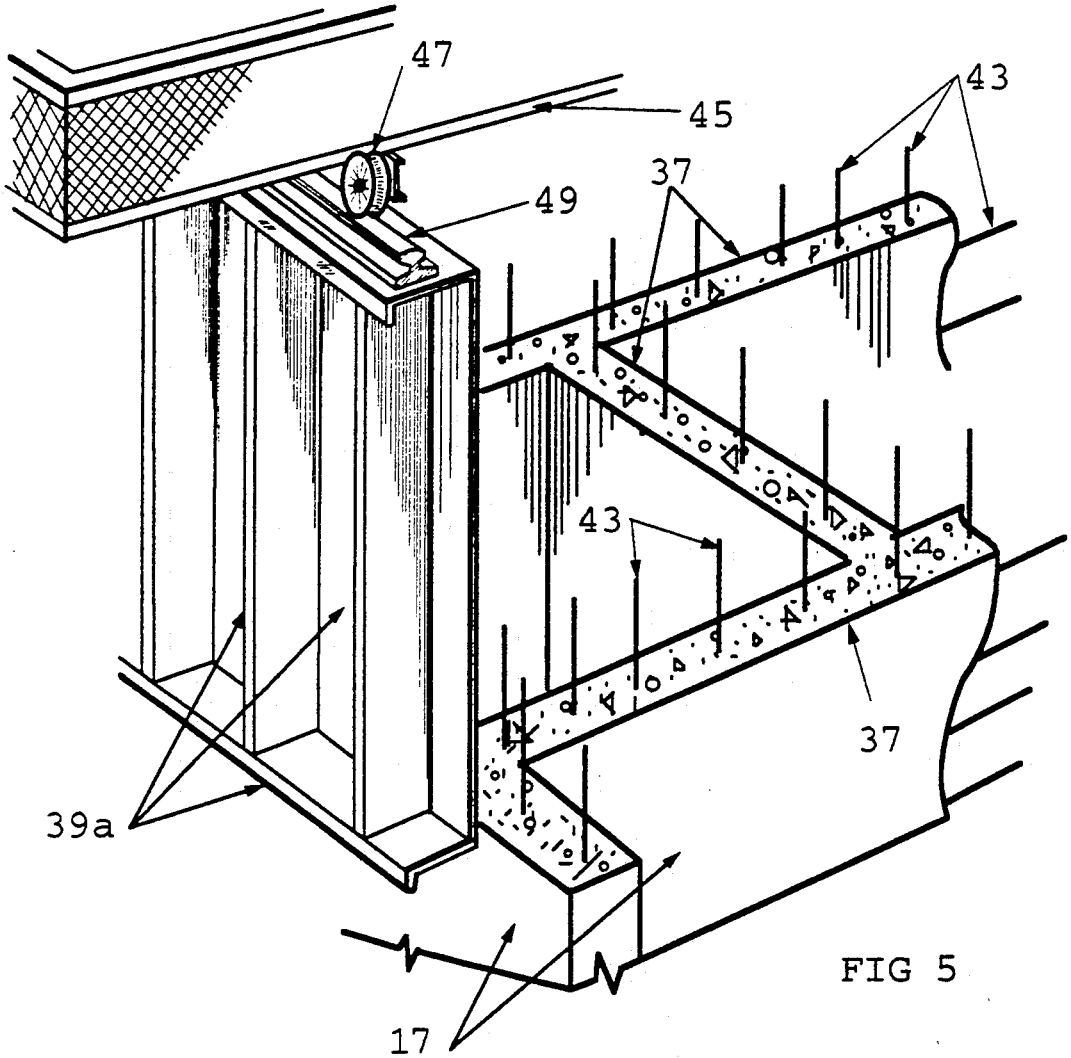
FIG. 5 is an enlarged perspective view of a portion the work platform of FIG. 4, resting on a rail supported on the upper edge of the core tower forms.

As shown in FIG. 5, which is a detailed view of the support structure for the movable work platform 45, it will be observed that the platform includes wheels 47 that ride on conventional steel tracks 49 secured to the top edges of the parallel core tower forms 39*a* and 39*b*. The platform can be moved along the tracks by any suitable means carried on the platform, itself.

A crane 51 mounted on the work platform 45 is used to lift equipment 52 from the ground into a selected position on the platform, itself, or on the core tower 17. Because the platform is selectively movable to any horizontal location on the core tower, the crane can have a relatively short boom 53, thus simplifying the construction and minimizing cost.

Figure 6:
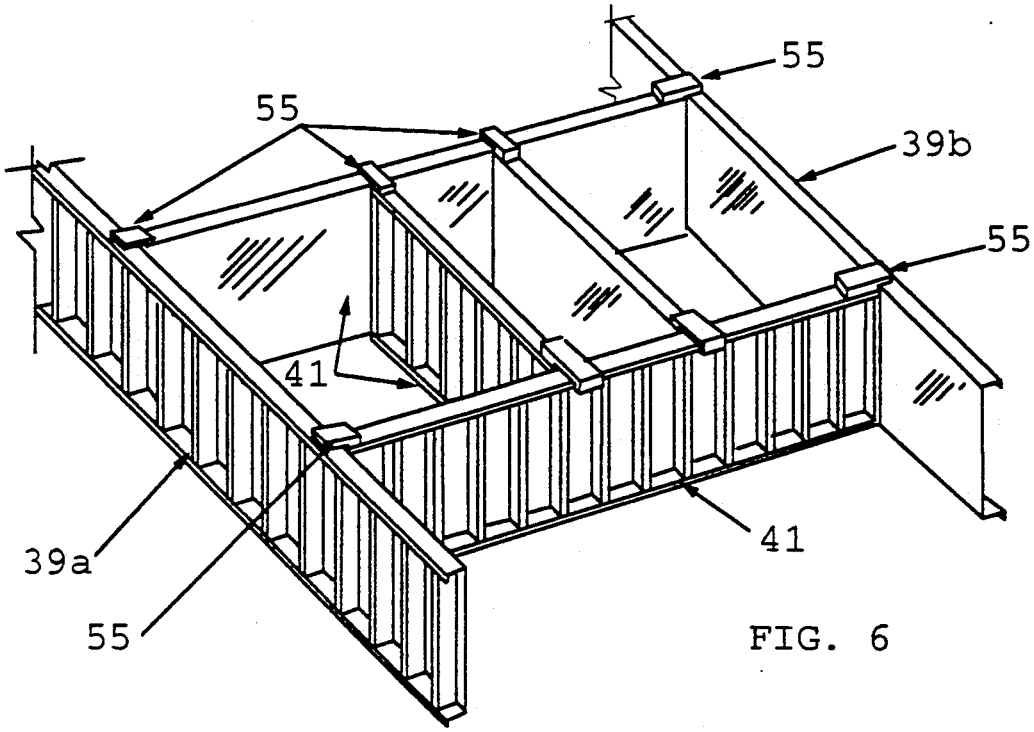
FIG. 6 is a perspective view of the forms used in producing interior walls of the core tower of FIG. 5, shown suspended from the forms for the core tower's parallel exterior walls.

In another feature of the invention, the forms 41 used to produce the interior walls 37 of the core tower 17 are supported by the exterior wall forms 39*a* and 39*b*. With reference to FIG. 6, it will be observed that this support can conveniently take the form of hooks 55 at the ends of the upper edges of each interior wall form, much like hanging file folders in conventional filing cabinets. This construction is not only exceedingly simple, but it facilitates a convenient lateral adjustment of the wall locations and spacings and also facilitates the lifting of the forms for the entire core tower by pushing upwardly merely on the exterior wall forms 39*a* and 39*b*.

Figure 7:
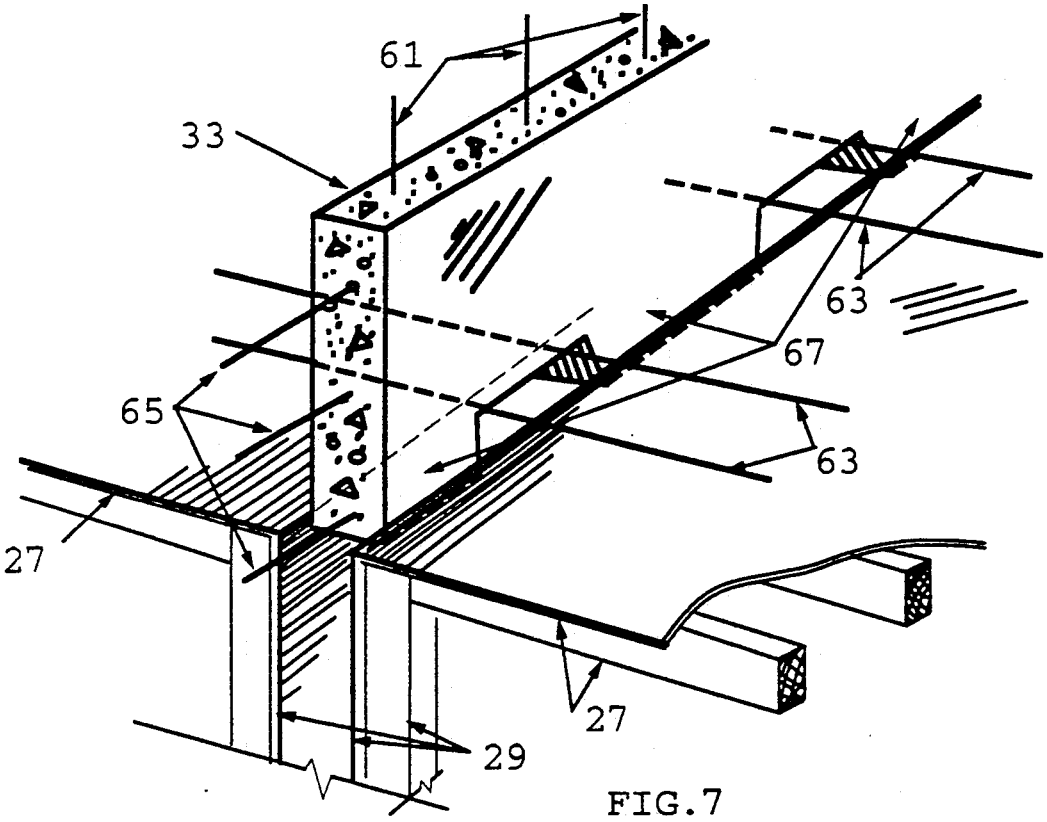
FIG. 7 is an enlarged view of a segment of the lower edge of a previously produced concrete wall in the building of FIG. 1, with downward protrusions from the wall being used to locate and space apart the forms being used to produce the corresponding wall for the next lower story.
Figure 8:
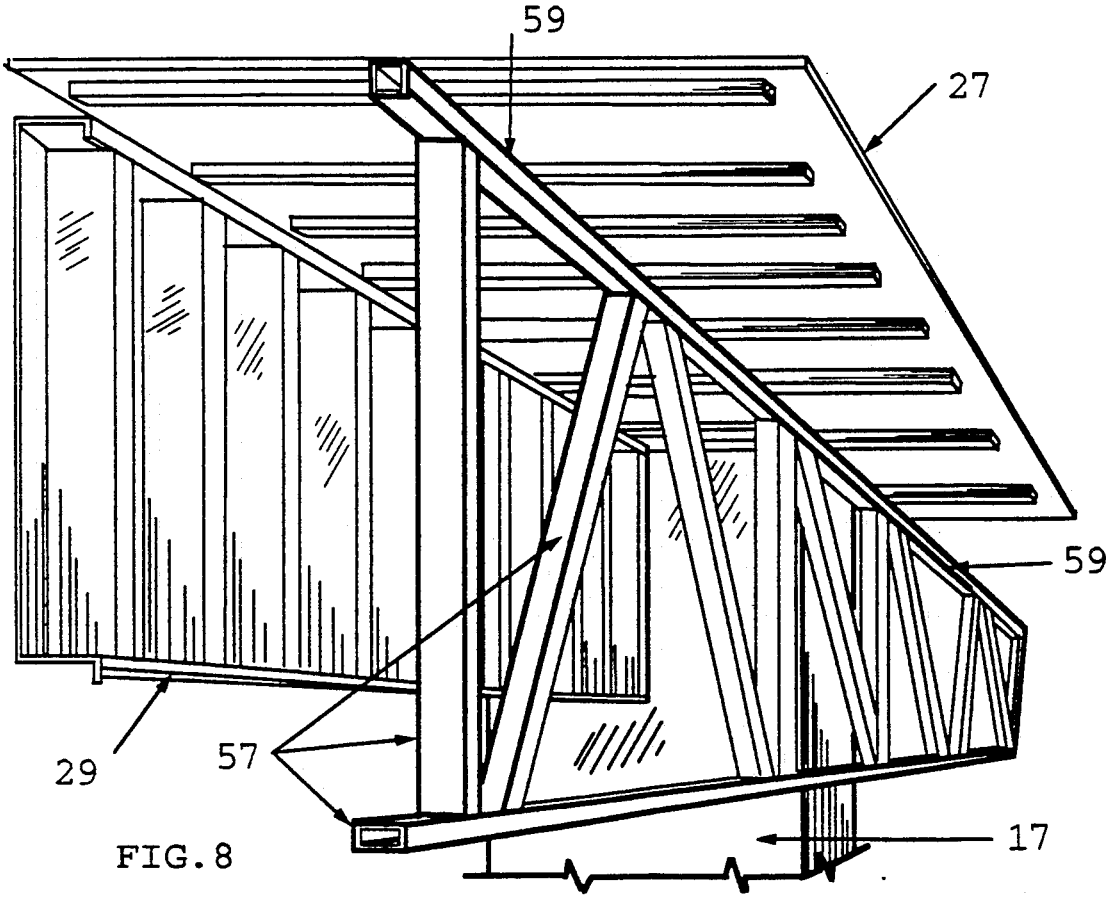
FIG. 8 is a perspective view of a segment of a truss used to support the forms for the main floor slabs of the concrete building of FIG. 1.

Eventually, the height of the core tower 17 will reach the building's desired height, and the construction process can proceed to the next phase, i.e., the construction of floor slabs 31 and underlying cantilevered walls 33 to the outside of the core tower. In particular, and with reference to FIGS. 1 and 2, the roof slab 31' and underlying walls 33 for the uppermost story are produced initially. The slab forms 27 and downwardly-protruding wall forms 29 for this structure are depicted in FIGS. 7 and 8. In particular, the horizontally-extending slab forms include smooth, upwardly presented surfaces for receiving concrete that will form the roof slab 31', and the downwardly-protruding, vertically-aligned forms 29 define wall cavities for receiving concrete that will form the underlying cantilevered walls 33. The roof slab and underlying walls are all made to be integral with each other and to extend all the way into abutment with the outwardly-facing walls of the core tower. Consequently, after concrete is poured into the forms and cured to at least a limited degree, the underlying walls will serve as a vertical support for the overlying slab, effectively transferring the weight of the slab and walls to the core tower. It will be appreciated that a cross-section of the slab and underlying walls takes the form of a series of "T's," which effectively resists downward bending of the cantilevered wall and slab.

With reference to FIG. 8, there is shown an outwardly-projecting support truss 57 for supporting along its top chord 59 the roof/floor slab forms 27 and the downwardly-protruding wall forms 29. In particular, the trusses span from one side of the building 11 to the other, extending through gaps in the core tower 17. These gaps ultimately form the entryways 21 for the various hotel rooms. A separate truss is located near the centerline of each room 25, intermediate each adjacent pair of walls 33 (see FIG. 2). The trusses preferably have a height of eight-to-ten feet each and a length of about 60 feet each.

After the roof slab 31' and underlying, integral walls 33 have cured sufficiently to support their own weight, the slab forms 27 and wall forms 29, which are resting on the underlying support trusses 57, are controllably lowered relative to the core tower 17 by an amount corresponding to the height of one story, i.e., about eight feet. The form/truss assembly is rigidly secured to the core tower at this lowered location by means of pockets (not shown) formed in the core walls that receive mating prongs in the formwork. The pockets are located at precisely spaced locations, so that the forms can be precisely positioned without the need for repeated measurements. The slab form 27 and wall forms 29 are prepared for reuse by applying appropriate bond breaker or paper/vinyl coverings. Fluid concrete is then poured into the forms to form the floor slab 31 for the building's uppermost floor, as well as integral underlying walls 33. As was the case with the roof slab 31' and its underlying walls 33, this slab 31 and underlying walls 33 likewise are configured to be self-supporting after the concrete has been poured and cured.

The process of lowering the forms 27 and 29 and support trusses 57 and placing concrete in those forms to form the next lower floor slab 31 and underlying, integral walls 33 is repeated numerous times until the slabs and interior walls for the entire building 11 have been completed. FIG. 1 depicts this process after three such slabs and underlying walls have been completed. In the drawing, the forms and underlying support trusses have been eliminated, for clarity.

In one feature of the invention, the aligned interior walls 33 of the successive stories are reinforced by reinforcement rods or strands 61 extending from the uppermost story completely to the ground. In particular, the reinforcement strands are hung from the site of the roof slab 31' at the time the forms 27 and 29 are initially constructed at the top of the core tower 17. As the successive stories are constructed, the wall forms 29 simply move downwardly in alignment with the hung reinforcement strands. This greatly simplifies the reinforcement procedure, by eliminating the need to separately hoist and splice together vertical rod segments each time a separate story is constructed. The lengthy reinforcement strands are initially hung in their predetermined positions by unwinding them from supply reels (not shown). Electrical conduits and associated connection boxes (not shown) can be hung from the site of the roof slab, in a similar fashion.

Horizontally disposed reinforcement rods 63 and 65 (FIG. 7) in the floor slab 31 and walls 33, respectively, also should be used, as is conventional. In the case of the slab rods that extend longitudinally, the rods can conveniently be unwound from supply reels.

It will be appreciated that, after curing, each successive floor slab 31 and its underlying, integral walls 33 are self-supporting and do not rely on any lower or higher support structure other than that provided by the central core tower 17. This feature of the construction process enables the slab forms 27, underlying wall forms 29, and support trusses 57 to be lowered away from the last-completed slab and walls without the need for any substitute shoring. This results in substantial savings in time and labor costs.

With reference now to FIG. 7, it will be observed that the lower edge of each internal wall 33 is made to be irregular, with a series of downward protrusions or teeth 67. These teeth are formed by appropriately configuring the lower edge of the wall form 29. These teeth serve several important functions. In particular, they control the position and spacing of the wall forms, and the spacing between the teeth allows the concrete to flow upwardly from the downwardly-protruding wall form to the floor slab form 27. The spacing between such teeth also allows the longitudinal slab reinforcement rods 63 to extend between adjacent rooms in the floor slab 31.

Figure 9:
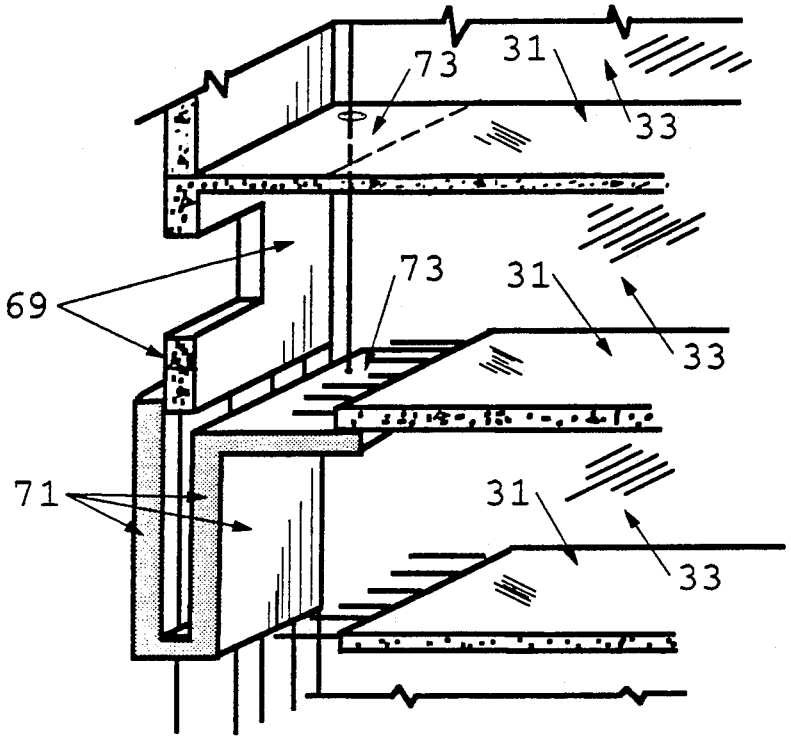
FIG. 9 is a side perspective view of forms used to produce an exterior wall and integral floor slab segment that abuts each main floor slab, in the concrete building of FIG. 1.

Thus far in the description, the construction of only the core tower 17, roof and floor slabs 31' and 31, and underlying interior walls 33 of the building 11 has been described. Exterior walls 69 for the building are constructed in a subsequent procedure. With reference now to FIG. 9 of the drawings, there is shown an exterior wall form 71 for use in forming the exterior wall for a portion of one story of the building. The exterior wall form is secured by appropriate means to the floor slab 31 for the next higher story and to that slab's underlying, integral walls 33.

The exterior wall form 71 is used not only to produce the exterior wall 69, but also a narrow floor slab segment 73 that abuts against the floor slab 31 already produced. This configuration enables the exterior wall form to be lowered a distance corresponding to one story, after the exterior wall and narrow floor slab segment have been produced. Preferably, the narrow floor slab segment has a width of about three feet.

It will be noted in FIG. 9 that the lower edge of the previously-formed exterior wall 69 terminates a short distance above the lower surface of the adjacent floor slab 31. This allows fluid concrete to flow freely between the exterior wall form and floor slab segment, so as to produce an integral structure of greater strength than if the two were poured separately. Appropriate reinforcement rods or strands (not shown) are, of course, placed in and above the forms to provide the exterior wall 69 and integral floor slab segment 73 with the requisite strength. As was described above, with reference to the interior walls 33, the reinforcement strands can be hung from the site of the uppermost story and extend completely to the ground. Although not shown in the drawings, granite or other desired facing material, as well as sheets of insulation, may be placed in the exterior wall forms 71 before pouring the concrete. Excellent strength and economy are thereby achieved.

With reference again to FIG. 3, it will be observed that the foundation 13 includes a plurality of temporary reinforcing strands 74 arranged to strengthen the portion of the foundation beneath the core tower 17. After the cantilevered stories have been fully constructed and the lowermost story has reached the foundation, the strands 74 may be removed from the foundation slab, causing a portion of the buildings weight to be transferred from the core tower to the walls 33 and 69. Although the strands 74 could be made permanent, they preferably are made temporary, for economic reasons. Removal of the temporary strands can be achieved conveniently by using loose-fitting plastic sheaths (not shown) that remain within the foundation slab.

Figure 10:
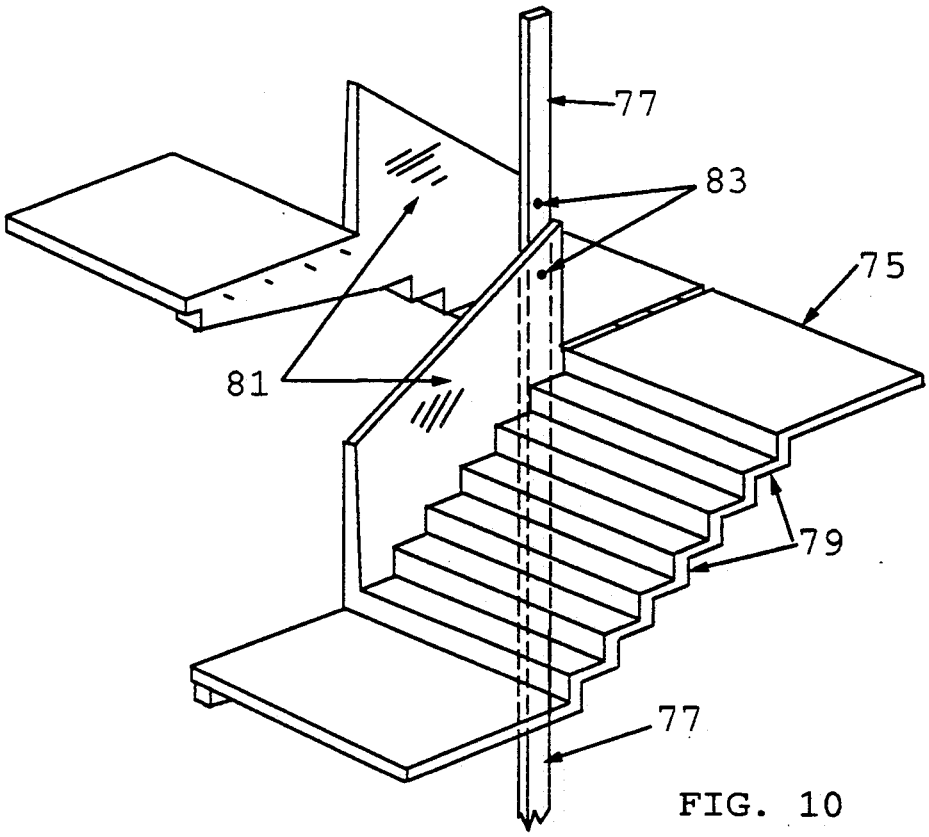
FIG. 10 is a perspective view of a reinforced concrete stair segment that is used in the concrete building of FIG. 1.

With reference now to FIG. 10, there is shown a monolithic stair flight segment 75 adapted for attachment to vertical columns 77 formed at one or both ends of the central core tower 17. The stair flight segment includes individual treads 79, risers 81, landing 83 and side wall or rail 85, all monolithically poured to form an integral unit. The rail is provided with appropriate openings aligned with corresponding openings in the columns, so as to receive appropriate fasteners 87. The integrated stair flight segments preferably are formed as units on the ground and raised at the appropriate time into place.

It should be appreciated from the foregoing description that the present invention provides an improved process for constructing a multiple-story, reinforced concrete building. A central core tower is first erected on a conventional foundation by moving concrete forms incrementally upwardly. A work platform is mounted for self-propelled movement along the top side of the core forms, to move men and equipment to selected locations on the tower as it is being erected, thus simplifying the construction and substantially reducing costs. After the core tower has been erected, floor slabs and integral, underlying walls are constructed from the uppermost floor downwardly using slab/wall forms that can be moved repeatedly downwardly without requiring disassembly and reassembly for each story. The integral, underlying walls associated with each floor slab provide the support structure for each story, thus permitting the slab/wall forms to be lowered without the need for re-shoring.

Although the invention has been described in detail with reference to the presently preferred process, those of ordinary skill in the art will appreciate that various modifications to the method can be made without departing from the invention. Accordingly, the invention is defined only by the following claims.

I claim:

1. A process for constructing a multiple-story, concrete building comprising steps of:

erecting a multiple-story core tower;

constructing forms for a floor slab and integral concrete wall positioned beneath the floor slab, projecting horizontally outwardly from the multiple-story core tower, at or near the top of the tower, and further constructing a horizontal support structure for supporting the forms;

placing concrete in the forms, to produce a floor slab and integral underlying wall, wherein the weight of the floor slab and integral wall is transferred directly to the core tower;

lowering the forms and horizontal support structure a predetermined distance beneath the previously produced floor slab and integral wall; and repeating the steps of placing and lowering until a selected number of floor slabs and underlying integral walls have been produced, wherein the weight of each such floor slab and integral wall is transferred directly to the core tower.

2. A process as defined in claim 1, wherein the horizontal support structure constructed in the step of constructing includes a truss projecting horizontally away from opposite sides of the core tower.

3. A process as defined in claim 1, wherein:

the successive concrete walls produced in the repeated steps of placing and lowering are vertically aligned with each other; and the process further includes a step, performed prior to the initial step of placing, of suspending a plurality of reinforcing strands from the site of the uppermost floor slab to the site of the lowermost floor slab, to strengthen the walls being successively produced.

4. A process as defined in claim 3, wherein the bottom edge of each wall produced in each step of placing is irregular, with a plurality of downward projections; and the downward projections on the bottom edge of each wall produced in each step of placing are used in the subsequent step of lowering, as a guide for use in controlling the locating and spacing of the forms for the underlying wall.

5. A process as defined in claim 1, and further including steps of:

constructing forms for an exterior wall at the edge of the uppermost floor slab furthest from the core tower;

placing concrete in the exterior wall forms to produce an exterior wall;

lowering the exterior wall forms a predetermined distance beneath the previously produced exterior wall; and repeating the steps of placing concrete in, and lowering, the exterior wall forms until a separate exterior wall has been produced for each floor slab.

6. A process as defined in claim 5, wherein:

the step of constructing forms for an exterior wall includes a step of constructing forms for a narrow floor slab segment integral with the exterior wall and abutting a previously produced floor slab; and the step of placing concrete in the exterior wall forms includes a step of simultaneously placing concrete in the forms for the narrow floor slab segment.

7. A process as defined in claim 1, wherein the core tower erected in the initial step of erecting and the floor slabs forms constructed in the subsequent step of constructing carry cooperating indicia for use in the repeated steps of lowering to determine the predetermined distances the forms and horizontal support structure are to be lowered.

8. A process as defined in claim 1, wherein the initial step of erecting the core tower includes steps of:

constructing core forms for an arrangement of walls of a predetermined, substantially uniform height, two of such walls being substantially parallel with each other;

placing tracks on the upper edges of the core forms for the two parallel walls; and selectively moving a work platform along the tracks placed on the upper edges of the two parallel walls, to move men and equipment to selected portions of the core forms and arrangement of walls.

9. A process as defined in claim 8, wherein the initial step of erecting the core tower further includes steps of:

lifting the core forms by a predetermined amount after the arrangement of walls has been produced; and repeating the second step of placing and the steps of selectively moving and lifting a selected number of times until the core tower has reached a predetermined height.

10. A process as defined in claim 8, wherein the step of constructing core forms includes a step of constructing forms for interior walls of the core tower, such forms being suspended from forms for the two substantially parallel walls, whereby lifting the forms for the two substantially parallel walls simultaneously lifts the suspended forms for the interior walls.

11. A process as defined in claim 1, and further including steps of:

monolithically casting a plurality of concrete stair/-rail segments that each include integral treads, risers, landing and railing; and lifting and attaching the plurality of stair/rail segments to vertical columns formed in the step of erecting.

12. A process for constructing a multiple-story building, comprising steps of:

constructing forms for an arrangement of walls of a predetermined, substantially uniform height, two of such walls being substantially parallel with each other;

placing tracks on the upper edges of the forms for the two parallel walls;

selectively moving a work platform along the tracks placed on the upper edges of the two parallel walls, to move men and equipment to selected portions of the forms and arrangement of walls;

placing concrete in the forms and allowing the concrete to cure, to form the arrangement of walls;

lifting the forms and overlying tracks and platform a predetermined distance relative to the arrangement of walls; and repeating the steps of placing and lifting a predetermined number of times, until a tower of a desired height has been constructed.

13. A process as defined in claim 12, wherein the step of constructing forms includes a step of constructing forms for interior walls of the building, such forms being suspended from forms for the two substantially parallel walls, thereby lifting the forms for the two substantially parallel walls simultaneously lifts the suspended forms for the interior walls.

14. A process as defined in claim 12, and further including steps of:

constructing slab/wall forms for a floor slab and integral concrete wall positioned beneath the floor slab, projecting horizontally outwardly from the tower, at or near the top of the tower, and further constructing a horizontal support structure for supporting the forms;

placing concrete in the slab/wall forms, to produce a floor slab and integral underlying walls, wherein the weight of the floor slab and integral wall is transferred directly to the tower;

lowering the slab/wall forms and horizontal support structure a predetermined distance beneath the previously produced floor slab and integral walls; and repeating the steps of placing and lowering until a selected number of floor slabs and underlying integral walls have been produced.

15. A process as defined in claim 14, wherein the horizontal support structure constructed in the step of constructing slab/wall forms includes a truss projecting horizontally away from opposite sides of the tower.

16. A process as defined in claim 14, wherein:

the successive concrete walls produced in the repeated steps of placing and lowering are vertically aligned with each other; and the process further includes a step, performed prior to the step of placing concrete in the slab/wall forms, of suspending a plurality of reinforcing strands from the site of the uppermost floor slab to the site of the lowermost floor slab, to strengthen the walls being successively produced.

17. A process as defined in claim 12, and further including steps of:

monolithically casting a plurality of concrete stair/-rail segments that each include integral treads, risers, landing and railing; and lifting and attaching the plurality of stair/rail segments to vertical columns formed in the repeated steps of placing.

18. A process for constructing a multiple-story concrete building comprising steps of:

constructing a multiple-story core tower, including steps of constructing forms for an arrangement of walls of a predetermined, substantially uniform height, two of such walls being substantially parallel with each other, placing tracks on the upper edges of the forms for the two parallel walls, selectively moving a work platform along the tracks placed on the upper edges of the two parallel walls, to move men and equipment to selected portions of the forms and arrangement of walls, placing concrete in the forms and allowing the concrete to cure, to form the arrangement of walls, lifting the forms and overlying tracks and work platform a predetermined distance relative to the arrangement of walls, and repeating the steps of placing and lifting a predetermined number of times, until the core tower of a desired height has been constructed;

constructing slab/wall forms for a floor slab and integral concrete walls positioned beneath the floor slab, projecting horizontally outwardly from the tower, at or near the top of the tower, and further constructing a horizontal support trusses projecting horizontally away from opposite sides of the core tower, for supporting the slab/wall forms;

suspending a plurality of reinforcing strands from the initial site of the slab/wall forms, to reinforce walls to be successively produced;

placing concrete in the slab/wall forms, to produce a floor slab and integral underlying walls, wherein the weight of the floor slab and integral walls is transferred directly to the core tower;

lowering the slab/wall forms and horizontal support trusses a predetermined distance beneath the previously produced floor slab and integral walls while maintaining the wall forms aligned with the suspended reinforcing rods;

repeating the steps of placing and lowering until a selected number of floor slabs and underlying integral walls have been produced;

constructing exterior wall forms for an exterior wall and integral floor slab segment, at the edge of the uppermost floor slab furthest from the core tower;

placing concrete in the exterior wall forms to produce an exterior wall and integral floor slab segment;

lowering the exterior wall forms a predetermined distance beneath the previously produced exterior wall; and repeating the steps of placing concrete in, and lowering, the exterior wall forms until a separate exterior wall has been produced for each floor slab.

* * * * *